United States Patent [19]

Burrill et al.

[11] 4,098,701

[45] Jul. 4, 1978

[54] PROCESS FOR TREATING FIBRES

[75] Inventors: Peter Martin Burrill, Cowbridge; William Samuel Kohnstamm, Rhiwbina, both of Wales

[73] Assignee: Dow Corning Limited, Barry, Wales

[21] Appl. No.: 805,261

[22] Filed: Jun. 10, 1977

[30] Foreign Application Priority Data

Jun. 26, 1976 [GB] United Kingdom ..... 26721/76

[51] Int. Cl.[2] ..... D06M 15/66

[52] U.S. Cl. ..... 252/8.6

[58] Field of Search ..... 252/8.6, 8.9; 8/115.6; 106/287 SB; 260/46.5 E

[56] References Cited

U.S. PATENT DOCUMENTS

| | | | |
|---|---|---|---|
| 3,306,759 | 2/1967 | Steinbach | 106/287 SB |
| 3,530,092 | 9/1970 | Borchert | 260/46.5 E |
| 3,705,120 | 12/1972 | Kawaguchi | 260/46.5 E |
| 3,719,632 | 3/1973 | Lengnick | 260/46.5 E |
| 3,737,336 | 6/1973 | Golitz et al. | 106/287 SB |
| 3,814,710 | 6/1974 | Duncan | 260/46.5 E |

*Primary Examiner*—William E. Schulz

*Attorney, Agent, or Firm*—Robert F. Fleming, Jr.

[57] ABSTRACT

Process for the treatment of cellulosic or synthetic fibres, or blends of these, to impart resilience and anti-pilling properties. The process comprises applying to the fibres a composition, especially an aqueous emulsion, containing (A) a polydiorganosiloxane in which at least two silicon-bonded substituents contain at least two amino groups, (B) a siloxane having silicon-bonded hydrogen atoms and (C) a siloxane curing catalyst.

9 Claims, No Drawings

PROCESS FOR TREATING FIBRES

This invention relates to a process for the treatment of cellulosic and synthetic fibres.

It is known to treat textile fibres, particularly cellulosic and synthetic fibres, with organopolysiloxanes to impart to the fibres properties such as water repellency and lubricity. Although the use of organopolysiloxanes to achieve such properties is now commercially well established there has been a need to improve other desirable properties of the fibres. In particular there has existed a desire to improve the resilience or crease resistance of cellulosic and synthetic fibres or blends of these, for example polyester-cotton. Any improvement in resilience is to be desired as it increases the resistance of fabrics to wrinkling and also imparts springiness and bounce. Although treatment with known organopolysiloxane compositions can improve the crease resistance of fabrics the improvement is generally small and is not durable to laundering or dry cleaning.

Another property which it would be desirable to impart, particularly to knitted acrylic fabrics, is that of resistance to pilling. Pilling may be described as the accumulation of small bundles of fibres on the surface of the fabric and usually is the result of abrasion of the fabric during wear.

It has been disclosed in German OLS No. 2,459,936 that the resilience of synthetic fabrics may be improved by treatment with an organopolysiloxane composition comprising the product obtained by mixing (A) a polydiorganosiloxane having terminal silicon-bonded hydroxyl radicals, (B) an organosilane having amine groups in the molecule and (C) a silane having alkoxy or alkoxyalkoxy groups in the molecule. Such products are, however, best suited for application to the fibres from a solvent carrier. For environmental and other considerations it is preferred to apply treatments of this kind from an aqueous carrier. Although aqueous emulsions of the products described in said German OLS can be prepared it is necessary to use the emulsions without delay for the best results. Such a procedure is often inconvenient and can lead to waste of product.

We have now found that an improvement in the resilience of cellulosic and synthetic fibres can be obtained by treatment of the fibres with a certain type of organopolysiloxane composition which can, if desired, be readily applied from an aqueous carrier. We have also found that treatment with the said organopolysiloxane composition can endow knitted synthetic fibres, particularly acrylic fibres, with a resistance to pilling.

According to this invention there is provided a process for the treatment of cellulosic and synthetic fibres which comprises applying thereto a composition comprising (A) a polydiorganosiloxane having a molecular weight of at least 2500 and terminal —OX radicals, wherein X represents a hydrogen atom, an alkyl radical having from 1 to 15 carbon atoms or an alkoxyalkyl radical having from 3 to 15 carbon atoms, at least two of the silicon-bonded substituents present in said polydiorganosiloxane being monovalent radicals composed of carbon, hydrogen, nitrogen and, optionally, oxygen, which radicals contain at least two amine groups and are attached to silicon through a silicon to carbon linkage, and at least 50 per cent of the total substituents in the polydiorganosiloxane being methyl radicals, any remaining substituents being monovalent hydrocarbon radicals having from 2 to 20 inclusive carbon atoms, (B) an organosiloxane having at least three silicon-bonded hydrogen atoms in the molecule and in which the organic radicals are alkyl radicals having less than 19 carbon atoms, and (C) a siloxane curing catalyst.

The invention also includes cellulosic and synthetic fibres whenever treated by the said process.

The polydiorganosiloxanes (A) employed in the process of this invention are linear or substantially linear siloxane polymers having a molecular weight of at least 2500 and —OX radicals attached to each terminal silicon atom, wherein X represents a hydrogen atom or an alkyl or alkoxyalkyl having up to 15 carbon atoms. Examples of the operative X radicals are methyl, ethyl, propyl and methoxyethyl. Preferably X represents the methyl radical or the ethyl radical. Up to 3 —OX radicals may be attached to each terminal silicon atom, the preferred polydiorganosiloxanes being those having one —OX radical attached to each terminal silicon atom. The polydiorganosiloxanes (A) can be prepared by known techniques for example by the equilibration of the appropriate cyclic siloxanes. A more preferred method of preparing the polydiorganosiloxanes (A) comprises reacting a silanol-terminated polydiorganosiloxane free of the specified amino-containing substituents with a silane $CH_3(XO)_2SiZ$ in which X is as hereinabove defined and Z represents a monovalent radical composed of carbon, hydrogen, nitrogen and, optionally, oxygen, which radical contains at least two amino groups and is attached to silicon through a carbon to silicon linkage.

At least two of the silicon-bonded substituents in (A) are the specified monovalent radicals composed of carbon, hydrogen, nitrogen and, optionally, oxygen and containing at least two amino groups. Preferably said amino-containing substituents have less than 21 carbon atoms and are joined to the silicon atom through a bridge of at least 3 carbon atoms. Any oxygen may be present in ether and/or carbonyl groups. Examples of the operative amino-containing substituents are $-(CH_2)_3NHCH_2CH_2NH_2$, $-(CH_2)_4NHCH_2CH_2NH_2$, $-CH_2CH(CH_3)CH_2NHCH_2CH_2NH_2$, $-(CH_2)_3NHCH_2CH_2NHCH_2CH_2NH_3$, $$-(CH_2)_3NHCH_2CH_2\overset{\overset{\displaystyle CH_2CH_2NH_2}{|}}{C}H(CH_2)_3NH_2$$

and $-(CH_2)_3NH(CH_2)_2NHCH_2CH_2COOCH_3$, the first three exemplified groups being preferred.

At least 50% of the silicon-bonded organic substituents in the polydiorganosiloxane are methyl radicals, any other radicals present in addition to said methyl radicals and the specified amino-containing substituents being monovalent hydrocarbon radicals having from 2 to 20 carbon atoms. Examples of such monovalent hydrocarbon radicals are ethyl, propyl, 2,4,4-trimethylpentyl, cyclohexyl, vinyl and phenyl. Preferably the organic radicals present in the polydiorganosiloxane in addition to the amino-containing radicals are substantially all methyl radicals.

The organosiloxanes which comprise component (B) of the compositions employed according to this invention are, in general, well-known materials. They may comprise any one or more organosiloxanes having at least three silicon-bonded hydrogen atoms in the molecule. They are preferably linear siloxane polymers but may be cyclic or branched or mixtures of all three types. The organic substituents present in the organosiloxane are preferably methyl radicals but other alkyl radicals having less than 19 carbon atoms, e.g. ethyl or 2,4,4-trimethylpentyl may also be present. The organosiloxanes (B) can be for example copolymers of dimethylbutylsiloxane units with methylhydrogen siloxane units, copolymers of dimethylhydrogensiloxane units, ethylhydrogensiloxane units and dimethylsiloxane units and copolymers of trimethylsiloxane units, dimethylsiloxane units and methylhydrogensiloxane units. Preferred as the organosiloxanes (B) are copolymers of trimethylsiloxane units and methylhydrogensiloxane units, with or without copolymeric dimethylsiloxane units. The relative proportions of (A) and (B) employed in forming the composition of this invention are not narrowly critical and will depend, at least partially, on the nature of (A) and (B). Generally (B) is employed in a proportion of from about 2 to 75%, preferably from 4 to 25%, by weight, based on the weight of (A) but higher or lower proportions may be more appropriate in certain cases.

Component (C) of the compositions employed according to this invention is a siloxane curing catalyst. A variety of substances are known which are capable of functioning as siloxane curing catalysts and include acids, bases and organic metal compounds. The preferred curing catalysts for use herein are the organic metal compounds, for example the metal carboxylates e.g. lead 2-ethyl-hexoate, zinc naphthenate, stannous octoate, dibutyltin dioctoate, di-n-octyltin diacetate, dibutyltin di(iso-octylthioglycollate), diorganotin alkoxides, e.g. dibutyltin diethoxide and dioctyltin dimethoxide, and titanium alkoxides e.g. butyl titanate, octylene glycol titanate and triethanolamine titanate. The most preferred catalysts are the organic tin compounds. The proportion of the catalyst (C) employed is not critical and depends to some extent upon the rate of cure and the bath life desired. Usually we prefer to employ from 0.25 to 10 per cent of (C) based on the total weight of (A) and (B).

The compositions comprising (A), (B) and (C) may be applied to the fibres employing any suitable application technique, for example by padding or spraying. From considerations of bath stability and application convenience they are best applied as a solution in an organic solvent or as an aqueous emulsion. Any appropriately volatile organic solvent can be employed to prepare the solvent-based compositions e.g. toluene, xylene, benzene, white spirit or perchloroethylene. The treating solutions can be prepared by merely mixing components (A), (B) and (C) with an organic solvent. The concentration of the treating solution will depend on the desired level of application of siloxane to the fabric and on the method of application employed. From about 0.1 to 7% by weight of total siloxane (A) and (B) represents the preferred application level.

The compositions employed in the process of this invention are particularly suitable for application to cellulosic and synthetic fibres from an aqueous carrier. We have found that the compositions can be made highly substantive to cotton and synthetic fibres, that is they can be made to deposit selectively on such fibres when applied thereto as aqueous emulsions. Such a property renders the compositions particularly suited for aqueous batch treatment by an exhaustion procedure. According to this method of treatment the fibres usually in the form of knitted or woven fabrics, are immersed in an aqueous emulsion of the composition whereby the composition becomes selectively deposited on the fibres. Such deposition is indicated by a clearing of the treating emulsion and in commercial practice preferably occurs during an immersion period of from about 10 to about 60 minutes. If desired, the degree and rate of deposition from the aqueous emulsion can be increased by incorporating into the emulsion a substance which assists such deposition. We have found that magnesium sulphate and sodium sulphate, for example are effective substances for this purpose. Also effective is triethanolamine titanate, especially in the presence of zinc acetate. Such substances may be employed in widely varying proportions, preferably from about 0.5 to about 50% based on the weight of (A).

Deposition of the composition on to the fibres may also be expedited by increasing the temperature of the aqueous emulsion, temperatures in the range from 25° to 70° C being generally preferred.

Preparation of the aqueous emulsions can be carried out by any conventional technique. Most conveniently (A), (B) and (C) are emulsified individually and the emulsions thereafter combined. The emulsifying agents are preferably of the non ionic or cationic types and may be employed singly or in combinations of two or more. Examples of the preferred emulsifying agents are the reaction products of alcohols and phenols with ethylene oxide such as the polyethoxyethers of nonyl phenol and octyl phenol and the trimethylnonyl ethers of polyethylene glycols, monoesters of alcohols and fatty acids such as glyceryl monostearate and sorbitan monolaurate, and ethoxylated amines such as those represented by the general formula

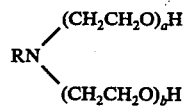

in which R is an alkyl group having from about 12 to about 18 carbon atoms and the sum of *a* and *b* is from 2 to about 15. The emulsifying agents may be employed in proportions conventional for the emulsification of siloxanes, from about 1 to about 20% by weight based on the weight of the siloxane emulsified usually being appropriate.

Following the application of the siloxane composition the treated fibres are dried and the siloxane cured. Drying and curing may be carried out by exposing the fibres to normal atmospheric temperatures for a period of from about 24 to 96 hours. Preferably, however, drying and/or curing are expedited by exposing the treated fibres to elevated temperatures, preferably from 50° to 170° C.

The process of this invention can be employed for the treatment of cellulosic and synthetic fibres, for example cotton, nylon, polyester and acrylic fibres. The fibres may be constituted by blends of two or more synthetic fibres or by a blend of synthetic and cellulosic fibres, for example as polyester-cotton blends. The fibres may be treated in any form, for example as knitted and woven fabrics and as piece goods. They may also be treated as agglomerations of random fibres as in filling materials for pillows and the like (fibrefill).

The following examples, in which the parts are expressed by weight, illustrate the invention.

EXAMPLE 1

A siloxane copolymer was prepared by heating together $CH_3(CH_3O)_2Si(CH_2)_3NHCH_2CH_2NH_2$ (7.5 parts) and a polydimethylsiloxane (1,000 parts) having a hydroxyl group attached to each terminal silicon atom and a viscosity of approximately 4,500 cS at 25° C. The heating step was performed under nitrogen for two hours at 150° C, the reaction mixture being efficiently stirred. The resulting copolymer product was a clear liquid having a viscosity of approximately 6,000 cS at 25° C.

The copolymer thus obtained was emulsified in water with the aid of Tergitol TMN 6 as emulsifying agent to provide an aqueous emulsion (Emulsion X) containing 35% by weight of copolymer. 66.7 parts of this emulsion was then mixed with 13.3 parts of an aqueous non ionic/cationic emulsion (Emulsion Y) containing 24% by weight of a trimethylsiloxy-terminated methylhydrogen polysiloxane (approximately 30 cS viscosity at 25° C) and 3.3 parts of a 40% by weight aqueous emulsion (Emulsion Z) of dibutyltin di(isoctylthioglycollate) and the emulsion made up to 1,000 parts by the addition of water. The resulting emulsion was employed to treat pieces of 50/50 cotton-polyester shirt fabric by padding at 50% mangle expression. The treated pieces were then placed in an oven at 150° C for 5 minutes to effect drying and to cure the siloxane. The siloxane add-on was 1% based on fabric weight.

Further pieces of the same fabric were treated by the same procedure as that described above except that the concentrations of active ingredients in the emulsion were increased threefold to give a siloxane add-on of 3% by weight.

The crease recovery angles of the treated polyester-cotton pieces were measured according to the procedure of British Standard Specification BS 3086. Recovery angles of 134° and 138° were obtained after 6 days for the 1% and 3% treatments respectively. The recovery angle for the untreated fabric was 104°.

EXAMPLE 2

Pieces of 50/50 polyester-cotton fabric (210 g./m.$^2$) were treated according to the procedure described in Example 1. Crease recovery angles were measured on the pieces (i) as treated, (ii) after three 15 minute immersions with agitation in perchloroethylene (simulated dry cleaning), and (iii) after three 15 minute launderings at 40° C in water containing textile soap (1 g. per liter). The values obtained were as follows:

| Siloxane add-on | (i) As treated | (ii) After dry cleaning | (iii) After laundering |
|---|---|---|---|
| 1% | 146° | 144° | 140° |
| 3% | 144° | 141° | 135° |

EXAMPLE 3

An aqueous composition was prepared by adding to water Emulsions X, Y and Z described in Example 1. The resulting aqueous composition containing 44g./liter of Emulsion X, 8.8 g./liter of Emulsion Y and 4.5 g./liter of Emulsion Z.

The aqueous composition was employed to treat by padding pieces of knitted fabric composed mainly of fibres of polyacrylonitrile. A mangle expression of 65% was employed to provide approximately 1% by weight add-on of siloxane. The treated fabric was dried at 100° C and then exposed to 150° C for 1 minute to cure the siloxane.

After 3 days storage under laboratory ambient conditions the pieces of treated fabric were tested in a Pill Tester by a modification of ICI Test Method 426. The treated fabric had a rating of 4 compared with a rating of 3 for untreated fabric and a maximum possible rating of 5.

EXAMPLE 4

3 g. of Emulsion X (as Example 1), 0.3 g. of Emulsion Y (as Example 1) and 0.1 g. of an aqueous solution containing 50% by weight of triethanolamine titanate and 11% by weight of zinc acetate were stirred into 2 liters of water and the resulting composition warmed to 25° C.

A piece of knitted polyacrylonitrile fabric (100 g.) was immersed in the aqueous composition and agitated for approximately 15 minutes until the composition became clear indicating that the siloxane had deposited on the fabric. Excess water was squeezed from the fabric which was then dried at 100° C and exposed to ambient laboratory atmosphere (22° C, 60% RH) for 3 days.

When tested for pilling after this time according to the procedure described in Example 3 the fabric had a rating of 4. Untreated fabric had a rating of 3.

EXAMPLE 5

3 g. of Emulsion X, 0.15 g. of Emulsion Y, 0.15 g. of Emulsion Z and 0.1 g. of an aqueous solution containing 50% by weight of triethanolamine titanate and 11% by weight of zinc acetate were stirred into 1.5 liters of water at 18° C. Knitted nylon fabric (100 g.) was immersed in the resulting aqueous composition and agitated. The composition became clear in 10 minutes indicating substantially complete deposition of the siloxane on the fabric.

Excess water was squeezed from the fabric which was then exposed to 165° C for 3 minutes. The fabric was stored for 3 days under laboratory ambient conditions and crease recovery angles measured as treated and after one and three launderings as described in Example 2. The values obtained were:

| | C.R.Angle |
|---|---|
| As treated | 156° |
| After 1 laundering | 151° |
| After 3 launderings | 149° |
| Untreated | 113° |

That which is claimed is:

1. A process for the treatment of fibres selected from cellulosic and synthetic fibres which comprises applying thereto a composition comprising (A) a polydiorganosiloxane having a molecular weight of at least 2500 and terminal -OX radicals, wherein X represents a hydrogen atom, an alkyl radical having from 1 to 15 carbon atoms or an alkoxyalkyl radical having from 3 to 15 carbon atoms, at least two of the silicon-bonded substituents present in said polydiorganosiloxane being monovalent radicals composed of carbon, hydrogen, nitrogen and, optionally, oxygen, which radicals contain at least two amine groups and are attached to silicon through a silicon to carbon linkage, and at least 50 per cent of the total substituents in the polydiorganosiloxane being methyl radicals, any remaining substituents being monovalent hydrocarbon radicals having from 2 to 20 inclusive carbon atoms, (B) an organosiloxane having at least three silicon-bonded hydrogen atoms in the molecule and in which the organic radicals are alkyl radicals having less than 19 carbon atoms, and (C) a siloxane curing catalyst.

2. A process as claimed in claim 1 wherein the polydiorganosiloxane has been prepared by the reaction of a silanol-terminated polydiorganosiloxane and a silane of the general formula $CH_3(XO)_2SiZ$ wherein X represents an alkyl radical having from 1 to 15 carbon atoms or an alkoxyalkyl radical having from 3 to 15 carbon atoms and Z represents a monovalent radical composed of carbon, hydrogen, nitrogen and, optionally, oxygen which radical contains at least two amino groups and is attached to silicon through a silicon to carbon linkage.

3. A process as claimed in claim 1 wherein X represents the methyl radical or the ethyl radical.

4. A process as claimed in claim 1 wherein the organosiloxane (B) is employed in a proportion of from 4 to 25 parts by weight based on the weight of (A).

5. A process as claimed in claim 1 wherein the composition is applied to the fibres in the form of an aqueous emulsion.

6. A process as claimed in claim 5 wherein the emulsion contains a substance which assists deposition of the siloxane on the fibres.

7. A process as claimed in claim 6 wherein the substance which assists deposition of the siloxane on the fibres is triethanolamine titanate.

8. A process as claimed in claim 7 wherein the emulsion also contains zinc acetate.

9. A process as claimed in claim 1 wherein the fibres after treatment with the composition are exposed to a temperature within the range from 50° to 170° C.

* * * * *